US006006448A

United States Patent [19]

Hellman

[11] Patent Number: 6,006,448

[45] Date of Patent: Dec. 28, 1999

[54] DISPOSABLE THIRD WEB BUBBLE PLASTIC SLIPPERS

[76] Inventor: Norman H. Hellman, 19670 Sawgrass Cir., 3101, Boca Raton, Fla. 33434-3384

[21] Appl. No.: 08/850,825

[22] Filed: May 2, 1997

Related U.S. Application Data

[60] Provisional application No. 60/021,147, Jul. 19, 1996.

[51] Int. Cl.[6] ..... A43B 5/08; A43B 3/10; A43B 13/20

[52] U.S. Cl. ..... 36/11.5; 36/44; 36/8.1; 36/10; 36/29

[58] Field of Search ..... 36/8.1, 11.5, 10, 36/93, 43, 44, 29

[56] References Cited

U.S. PATENT DOCUMENTS

| | | | |
|---|---|---|---|
| 2,090,881 | 8/1937 | Wilson | 36/44 |
| 3,058,241 | 10/1962 | Rigsby | 36/11.5 |
| 3,589,037 | 6/1971 | Gallagher | 36/44 |
| 4,030,212 | 6/1977 | Ito | 36/11.5 |
| 4,112,599 | 9/1978 | Krippelz | 36/11.5 |
| 4,145,822 | 3/1979 | Mitchell | 36/87 |
| 4,356,642 | 11/1982 | Herman | 36/44 |
| 4,864,737 | 9/1989 | Marrello | 36/29 |
| 5,274,846 | 1/1994 | Kolsky | 2/2 |
| 5,606,807 | 3/1997 | Prepodnik | 36/8.1 |
| 5,763,336 | 6/1998 | Jones et al. | 442/382 |

*Primary Examiner*—Bryon P. Gehman
*Assistant Examiner*—Anthony Stashick
*Attorney, Agent, or Firm*—Alvin S. Blum

[57] ABSTRACT

A scuff type slipper is produced so economically that it may be disposable, yet it has excellent cushioning properties and a sole with sufficient stiffness that the heel end will not fold under when in use. The slipper is produced from third web cushioning material. This has two planar thermoplastic webs spaced apart from one another by a middle thermoplastic web in the form of a plurality of bubbles hermetically sealed to the outer webs, trapping gas in the bubbles for cushioning and imparting stiffness. A vamp portion is formed by folding over a strip of the material at the toe end and fusion bonding it along the sides to the sole of the slipper and then cutting the slipper from the strip.

8 Claims, 1 Drawing Sheet

DISPOSABLE THIRD WEB BUBBLE PLASTIC SLIPPERS

This claims benefit of provisional application Ser. No. 60/021,147 filed Jul. 19, 1996.

BACKGROUND OF THE INVENTION

This invention relates to inexpensive slippers and more particularly to disposable plastic slippers made from third web bubble plastic cushioning material.

It is well known to make slippers and other footwear out of plastic materials and even plastic coated paper when they are to be used briefly and then thrown away, such as at public baths, swimming pools, hotels and hospitals.

U.S. Pat. No. 4,112,599 issued Sep. 12, 1978 to Krippelz discloses slippers made from common two web bubble wrap sheet material commonly used in cushioning packages. This is made from two thin polyethylene plastic sheets. A first cushioning sheet is formed with a plurality of separate and independent 1/2 inch diameter pockets spaced apart about 1/16 inch. A second planar sheet is sealed against the concave side of the first sheet to close the pockets or bubbles and seal air in each bubble. The slippers are fashioned with the convex side of the bubbles against the foot so that there will be ample ventilation at the foot surface by the spaces between the bubbles enabling air and moisture to move freely against the skin while the bubbles cushion the step.

This avoids what he refers to as the "plastic raincoat effect" of perspiration and dampness when sheet plastic is in contact with the skin. However, there are unfortunate consequences of this type of construction. Because the heel produces extraordinary pressure forces on the bubbles when walking,, they are easily burst. Then one is walking on a thin sheet of plastic without cushioning. Sliding the foot into a slipper lined with bubbles is very difficult, because the bubbles create a high friction surface. His structure includes an outsole attached to the insole with the bubbles extending outward to the floor. This increases the frictional resistance of the slipper against the floor. With a loose fitting slipper of this sort, it is preferable to have an outsole with a low friction surface.

Good quality slippers have an upstanding heel portion that prevents the annoying tendency for the heel portion of the sole to fold under in use. Scuff-type slippers i.e. those without an upstanding heel portion are so inexpensive to fabricate that most disposable slippers, including the Krippelz slipper are of the scuff type. U.S. Pat. No. 4,145,822 issued Mar. 27,1979 to Mitchell incorporates special structure to overcome this tendency for the heel portion of the sole to fold under but at considerable cost and complexity.

SUMMARY IF THE INVENTION

It is accordingly an object of the invention to provide a slipper with soft cushioning and smooth inner and outer surfaces that can be made economically from an inexpensive sheet material. It is yet another object that the slipper not lose its cushioning under the stress of use, nor have the sole fold under.

The slipper of the invention is made from a cushioning material that is known as third web bubble. It is a sheet stock used in the furniture industry. It is comprised of three thin plastic films. A top and a bottom film are fused to a middle film. The middle film has pockets or bubbles that are individually sealed by the bottom film so that air is trapped in each bubble. The top film is sealed to the convex surface of the bubbles. The top and bottom films are substantially planar. The slipper is formed from the sheet stock by folding over one edge of the sheet material and then heat sealing the edges and cutting out the slipper. The resulting slipper has bubbles for cushioning that are more resistant to bursting with relatively smooth top and bottom surfaces, and a relatively stiff sole portion.

These and other objects, features and advantages of the invention will become more apparent when the detailed description is studied in conjunction with the drawings in which like elements are designated by like reference characters in the various drawing figures.

BRIEF DESCRIPTION OF THE INVENTION

DETAILED DESCRIPTION OF PREFERRED EMBODIMENTS

Figure 1:
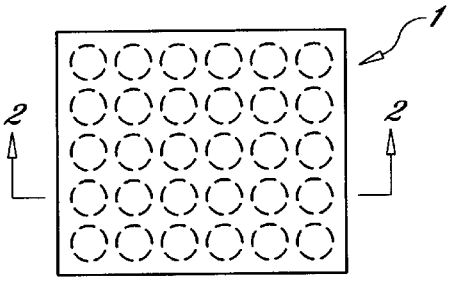
FIG. 1 is a plan view of third web bubble sheet.
Figure 2:
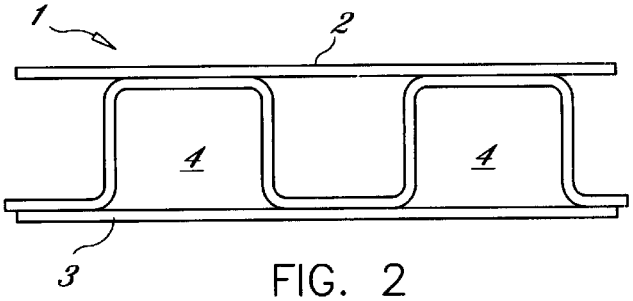
FIG. 2 is a sectional view through line 2—2 of FIG. 1.

Referring now first to FIGS. 1 and 2, the nature of the third web bubble sheet stock is described.

The structure of the third web bubble sheet 1 provides inherent stiffness not found in most inexpensive sheet stock including the two web bubble sheet stock of Krippelz. The two outer webs, a top web 2 and a bottom web 3, of the third web bubble sheet stock employed in Applicant's slipper have considerable tensile strength and resistance to stretching. They are spaced apart by the bubbles 4. In order to bend the stock, the bubbles must compress or one of the outer webs must stretch. This is what gives the sole of the slipper inherent stiffness and causes the heel portion to resist folding under. It also gives an elasticity to the vamp that better holds it to the foot.

The third web bubble sheet stock is generally made from polyethylene plastic that is readily fusion bonded by a heater platen press, not shown, for inexpense joining of parts. The stock may be provided slit to size on large rolls and processed continuously by automatic machinery.

Figure 3:
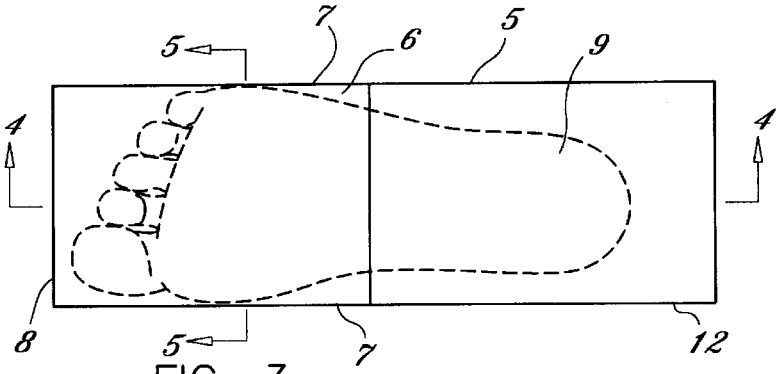
FIG. 3 is a plan view of a slipper of the invention.
Figure 5:
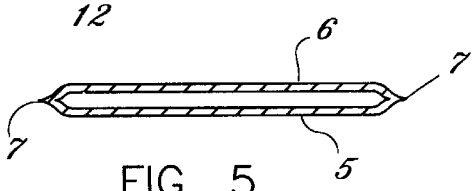
FIG. 5 is is a sectional view through line 5—5 of FIG. 3.
Figure 4:
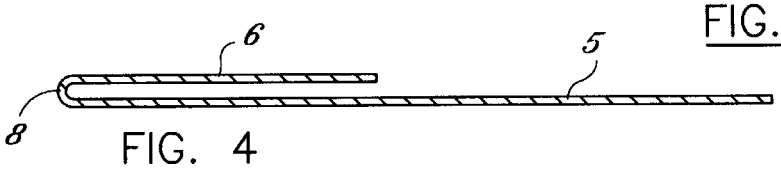
FIG. 4 is a sectional view through line 4—4 of FIG. 3.

Referring now to FIGS. 3–5, the scuff-type slipper 10 of the invention comprises a sole portion 5 and a vamp portion 6 joined to the sole portion along the two sides 7 by thermal bonding means well known in the art. Because the bubbles 4 are hermetically sealed by thermal bonding to top web 2 and bottom web 3, any compressive forces such as from a user's foot 9 will be distributed over a great area and many bubbles. This greatly reduces the chance of a bubble bursting from use.

The entire slipper may be made from a single piece of material by simply folding over a portion of the sheet so that the fold is at the toe end 8 of the sole portion 5 and the folded over portion becomes the vamp portion 6. This folding over process may be done continuously as the sheet stock comes off the roll. After folding over, the sides 7 may be thermally bonded and the slipper cut from the roll. Alternatively, the slipper outline 12 may be only partially cut through, so that a strip of slippers may be provided to be torn off one at a time at the point of use.

Figure 6:
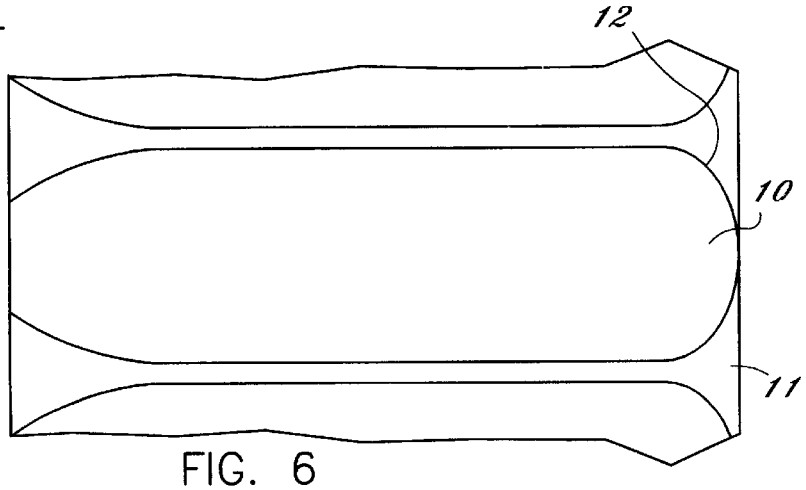
FIG. 6 is a plan view of another embodiment of the invention.

Referring now to FIG. 6, another embodiment of the invention comprises a scuff-type slipper 10 of the invention better shaped to conform to the bottom of a foot. The vamp 6 may be formed by folding over a portion of the third web bubble sheet stock as above described. Alternatively, the vamp portion 6 may be formed from a separate piece of sheet material that is heat bonded along the sides 7 to the sole portion 5. The slipper 10 is shown as part of a continuous strip 11. The outline 12 of the slipper 10 may be formed by partially cutting through the strip 11 so that the slipper may be separated from the strip at a later time. This may facilitate packaging and handling of the product.

The above disclosed invention has a number of particular features which should preferably be employed in combination although each is useful: separately without departure from the scope. of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A slipper comprised of a sole portion and a vamp portion attached to the sole portion, both portions being formed of a material having a substantially planar thermoplastic top web and a substantially planar thermoplastic bottom web spaced apart by a thermoplastic middle web, the middle web being in the form of a plurality of bubbles bonded to the top and bottom webs so that the bubbles are hermetically sealed, trapping gas therein, the material thereby having a cushioning property from the bubbles and a stiffness property from the spaced apart top and bottom webs, said stiffness property being sufficient to prevent said sole portion from folding under in use.

2. The slipper according to claim 1 wherein the slipper is formed of a single folded over sheet of third web bubble material.

3. The slipper according to claim 2 wherein both said portions of the slipper are heat bonded together.

4. The slipper according to claim 1 wherein both said portions of the slipper are heat bonded together.

5. A scuff slipper comprising:

A) a sole portion with toe and heel ends and elongate side edges, the sole portion being of a material having a substantially planar thermoplastic top web and a substantially planar thermoplastic bottom web spaced apart by a thermoplastic middle web, the middle web being in the form of a plurality of bubbles bonded to the top and bottom webs so that the bubbles are hermetically sealed, trapping gas therein, the material thereby having a cushioning property from the bubbles and a stiffness property from the spaced apart top and bottom webs, said stiffness property being sufficient to prevent said sole portion from folding under in use; and B) a vamp portion attached to the toe end of the sole portion and extending part way to the heel and of the sole portion, the vamp being attached also to the side edges if the sole portion.

6. The slipper according to claim 5, in which the vamp portion is attached to the sole portion by fusion bonding.

7. The slipper according to claim 5, in which the vamp portion is formed by folding over an elongate strip of the material and fusion bonding the sides of the vamp portion to the sides of the sole portion and at least partially cutting out the slipper from the strip.

8. The slipper according to claim 7, in which the slipper is partially cut away from the strip for separation therefrom at a later time.

* * * * *